160-235 SR
7/1/86 OR 4,597,429

United States Patent [19]
Driessen

[11] Patent Number: 4,597,429
[45] Date of Patent: Jul. 1, 1986

[54] VERTICAL WINDOW BLIND SLATS

[75] Inventor: Edgar Driessen, Schlitz, Fed. Rep. of Germany

[73] Assignee: Bautex Adolf Stover Sohne KC, Langen, Fed. Rep. of Germany

[21] Appl. No.: 681,239

[22] Filed: Dec. 13, 1984

Related U.S. Application Data

[63] Continuation of Ser. No. 379,435, May 18, 1982, abandoned.

[30] Foreign Application Priority Data

May 22, 1981 [DE] Fed. Rep. of Germany ..... 3120364

[51] Int. Cl.[4] ..... E06B 9/36
[52] U.S. Cl. ..... 160/236; 160/166 A
[58] Field of Search ..... 160/166 A, 236, 178, 160/168

[56] References Cited

U.S. PATENT DOCUMENTS

| | | | |
|---|---|---|---|
| 1,750,047 | 3/1930 | Metzger | 160/176 X |
| 1,841,065 | 1/1932 | Simon | 160/166 A |
| 2,604,159 | 7/1952 | Wright | 160/166 A |
| 2,625,219 | 1/1953 | Peck | 160/166 A |
| 3,106,240 | 10/1963 | Weber | 160/236 X |

FOREIGN PATENT DOCUMENTS

| | | | |
|---|---|---|---|
| 2293570 | 7/1976 | France | 160/166 A |

*Primary Examiner*—Ramon S. Britts
*Assistant Examiner*—David M. Purol
*Attorney, Agent, or Firm*—Roberts, Spiecens & Cohen

[57] ABSTRACT

A vertical window blind slat with an upper hanger and a lower stress imparting weight has the hanger and/or weight element arranged on the slat so that the tension produced by the weight occurs at least primarily along the edge.

8 Claims, 8 Drawing Figures

VERTICAL WINDOW BLIND SLATS

This is a continuation on application Ser. No. 379,435, filed May 18, 1982, now abandoned.

BACKGROUND OF THE INVENTION

The invention concerns a vertical window blind slat with an upper hanger component and a lower, weighted component which imparts a stress.

Vertical window blinds are well known as sun- and privacy screens. For the purpose of hanging the slat a hanger is usually inserted into an upper loop of the slat, the hanger being provided with a nose piece which is passed through an opening in the loop. In the lower loop of the slat a metal plate is generally placed which provides the means for imparting the stress.

With such a design there is no certainty that the tendency of the slat to twist, or to turn on its longitudinal axis, is completely eliminated. While the bottom component imparting the stress can be increased with respect to its weight, certain limits are set by the nature of the assembly.

SUMMARY OF THE INVENTION

An object of the invention is to provide a vertical window blind slat with an upper hanger and a lower, stress-imparting component which is so designed that the tendency of the slat to twist is substantially reduced.

This is achieved according to the invention by so arranging the hanger and/or the weight on the slat such that the stress imparted to the slat by the weight occurs exclusively or primarily along the edge of the slat. Force actions are thereby generated which can be compared to a swing board suspended from two ropes.

More specifically, the invention comtemplates that the hanger and the weight can be plate- or band-shaped components, for example of metal, which have projections or protuberances which extend upwardly or downwardly along the edge of the slat. The plate- or band-shaped components are placed in the terminal loops of the slat so that the projections or protuberances convey the stress only along the edges of the slat.

According to another embodiment of the invention, the weights are of plate or cylinder form or of any other geometrical configuration, fastened from outside to the edge of the slat.

In the case of slats made from a material whereby in the longitudinal axis undulation might be anticipated because of the insufficient rigidity of the material, these components can be connected with each other by cross-pieces so as to achieve a certain stretching effect in the cross direction of the slat.

BRIEF DESCRIPTION OF THE DRAWING

In the drawing several designs are shown by way of example and not limitation.

DETAILED DESCRIPTION OF THE PREFERRED EMBODIMENTS

Figures 1, 2, 3, 3A:
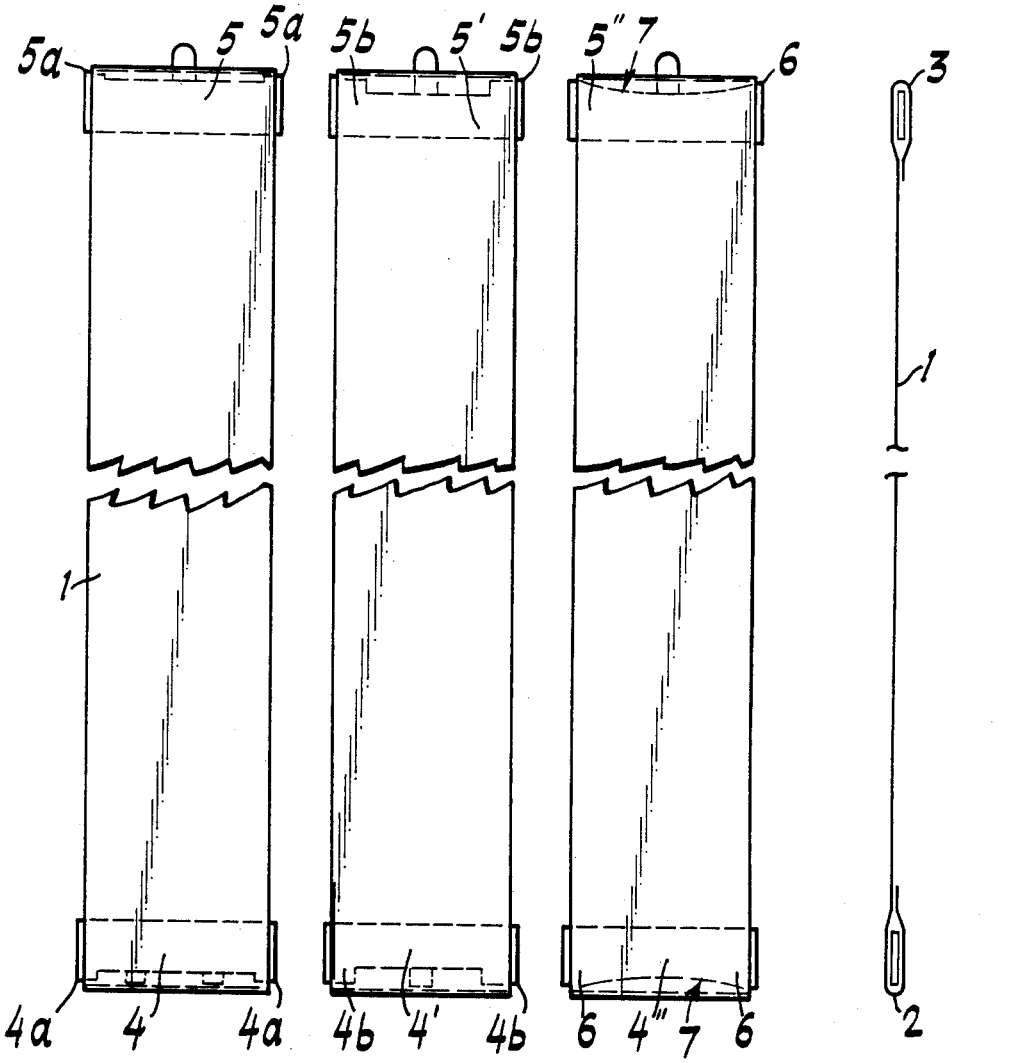
FIGS. 1–3 show a number of embodiments in which the hanger and the weight are basically plate-shaped components set into the terminal loops of the slats.
FIG. 3*a* shows a longitudinal cross-section of the slat in accordance with the embodiment shown in FIG. 3.

In FIG. 1 the slat is indicated by reference numeral 1. It has, in familiar fashion—as seen particularly in FIG. 3*a*—at its lower and upper ends the loops 2,3. Into these loops are placed the hanger and the stress-imparting weight in the form of the plate-shaped components 4 and 5. These plate-shaped components have projections 4*a* and 5*a* as shown in FIG. 1. In FIG. 2 the plate-shaped components are shown at 4′ and 5′ and have projections 4*b* and 5*b*. The plate-shaped components brace each other along the edges of the slat, as well as within the slat.

In the design shown in FIG. 2 the projections 4*b*, 5*b* designed with greater breadth than projections 4*a* and 5*a*.

In the design shown in FIG. 3, the plate-shaped components 4″ and 5″ are provided with a protuberance 6 at the edge, which is brought about by the fact that middle section of the plate-shaped component has a depression 7.

Figure 4:
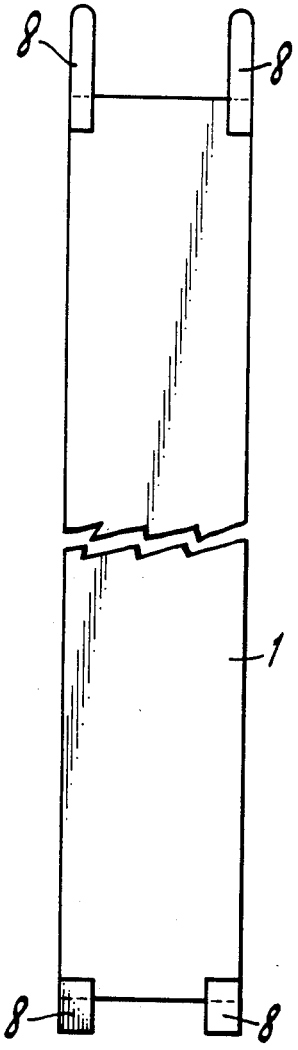
FIGS. 4–6 show an embodiment whereby the hanger and the weight are attached from the outside to the slat.
Figure 4A:
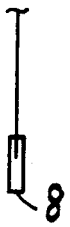
FIG. 4*a* shows a cross-section through the lower part of the slat.

In the design shown in FIG. 4 the hanger and weight are components fastened to the slat from the outside along the edge of the slat. These components can also be plate-shaped (cf. FIG. 4*a*) and can be connected to the slat in any fashion, for example by gluing, bolting or the like.

Figure 5:
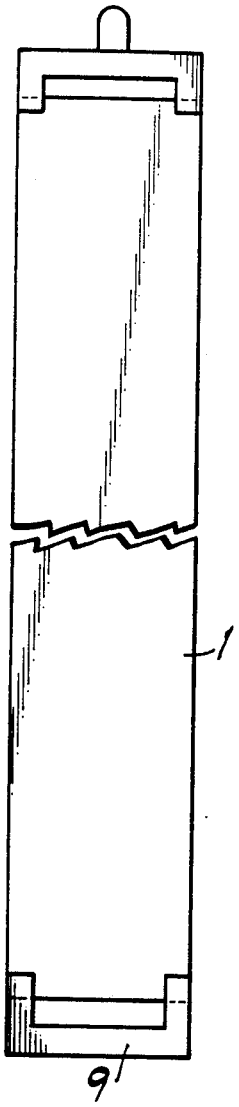

FIG. 5 shows basically the same design as FIG. 4; however, the components attached to the slat are connected to each other by a cross-piece 9.

Figure 6:
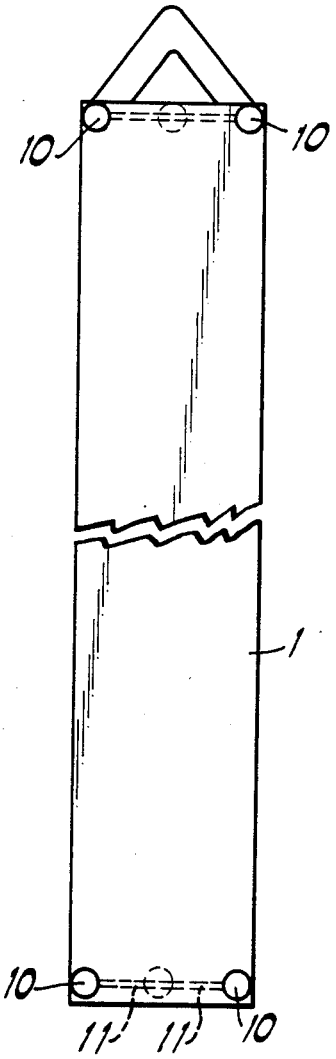

FIG. 6 shows still another embodiment in which the components attached to the slat from the outside are cylindrical pieces 10.

If the slat, because of its insufficiently rigid material has a tendency to develop undulations along its longitudinal axis, then these components attached from the outside to the slat can be connected to each other by cross-pieces 11.

What is claimed is:

1. A vertical window blind slat assembly comprising a vertical slat having opposite longitudinal edges and upper and lower edges, hanger means at the upper edge of the slat for suspending the slat vertically, said hanger means including two hanger components bearing against the upper edge of said slat respectively at said longitudinal edges, the upper edge of said slat apart from its engagement with said hanger components being left free, and weight means at the lower edge of said slat to impart stress in the slat, said weight means including two weight components bearing against the lower edge of said slat respectively at said longitudinal edges, the lower edge of said slat apart from its engagement with said weight components being left free, said weight components being respectively aligned with said hanger components at the longitudinal edges of said slat to impart stress in the slat substantially only at said longitudinal edges whereby to avoid any tendency of the slat to twist.

2. A vertical window blind slat assembly as claimed in claim 1 wherein said hanger means further comprises a cross-piece connecting said two hanger components together and otherwise unconnected to said slat.

3. A vertical window blind assembly as claimed in claim 1 wherein said weight means further comprises a cross-piece connecting said two weight components together and otherwise unconnected to said slat.

4. A vertical window blind slat assembly as claimed in claim 1 wherein said hanger means further comprises a cross-piece connecting said two hanger components together and otherwise unconnected to said slat and wherein said weight means further comprises a cross-piece connecting said two weight components together and otherwise unconnected to said slat.

5. A vertical window blind slat assembly as claimed in claim 1 wherein at least one of said hanger means and weight means comprises a plate-shape element having side edges including projections respectively forming said components.

6. A vertical window blind slat assembly as claimed in claim 5 wherein said slat includes a loop at one of said upper and lower edges, said plate shape element being disposed in said loop.

7. A vertical window blind slat assembly as claimed in claim 5 wherein said projections are on said plate-shape element of said hanger means and extend upwardly.

8. A vertical window blind slat assembly as claimed in claim 5 wherein said projections are on said plate-shape element of said weight means and extend downwardly.

* * * * *